United States Patent [19]

Schoerner et al.

[11] 4,082,573

[45] * Apr. 4, 1978

[54] HIGH TENSILE STRENGTH ALUMINUM ALLOY CONDUCTOR AND METHOD OF MANUFACTURE

[75] Inventors: Roger J. Schoerner; Enrique C. Chia, both of Carroll County, Ga.

[73] Assignee: Southwire Company, Carrollton, Ga.

[ * ] Notice: The portion of the term of this patent subsequent to May 21, 1991, has been disclaimed.

[21] Appl. No.: 633,072

[22] Filed: Nov. 18, 1975

Related U.S. Application Data

[60] Continuation-in-part of Ser. No. 430,300, Jan. 2, 1974, Pat. No. 3,920,411, which is a continuation of Ser. No. 199,729, Nov. 17, 1971, abandoned, which is a division of Ser. No. 54,563, Jul. 13, 1970, abandoned.

[51] Int. Cl.[2] ..... C22F 1/04

[52] U.S. Cl. ..... 148/2; 75/138; 148/11.5 A; 148/12.7 A; 148/32; 148/32.5

[58] Field of Search ..... 75/138–148; 148/2, 11.5 A, 32, 32.5, 12.7 A

[56] References Cited

U.S. PATENT DOCUMENTS

| | | | |
|---|---|---|---|
| 3,811,846 | 5/1974 | Schoerner et al. | 75/138 |
| 3,920,411 | 11/1975 | Schoerner et al. | 75/138 |

*Primary Examiner*—R. Dean

*Attorney, Agent, or Firm*—Herbert M. Hanegan; Stanley L. Tate; R. Steven Linne

[57] ABSTRACT

This disclosure relates to a high tensile strength aluminum alloy electrical conductor that is manufactured by alloying at least one alloying element with molten aluminum in sufficient proportion to yield intermetallic precipitates during subsequent solidification and thermomechanical processing. The conductor is in the form of a hard-drawn wire which is annealed at a temperature within the range corresponding to the onset of recovery such that there will be produced secondary intermetallic precipitates corresponding to the primary precipitates which come out of solution during casting, whereby both the primary and secondary precipitates act to pin dislocation sites between adjacent subgrain boundaries in the aluminum matrix thereby increasing the ultimate tensile strength and yield strength of the conductor.

14 Claims, 4 Drawing Figures

HIGH TENSILE STRENGTH ALUMINUM ALLOY CONDUCTOR AND METHOD OF MANUFACTURE

CROSS-REFERENCE TO RELATED APPLICATIONS

This application is a continuation-in-part of copending application Ser. No. 430,300, filed Jan. 2, 1974, now U.S. Pat. No. 3,920,411, which was a continuation of application Ser. No. 199,729, filed Nov. 17, 1971, which in turn was a division of application Ser. No. 54,563, filed July 13, 1970, both now abandoned.

BACKGROUND OF THE INVENTION

This invention relates to an aluminum alloy wire that is particularly suitable for use in conducting electricity, as well as to the manufacture thereof. The wire produced by the method of this invention has improved properties of yield strength and ultimate tensile strength which renders it particularly suitable for use in cable constructions requiring conductive elements capable of carrying large tensile loads.

Although the wire produced by the method of this invention will not normally have sufficient electrical conductivity and elongation characteristics such as to qualify it according to present standards for use in building wire, its high tensile strength properties, coupled with improved properties of fatigue resistance and creep resistance as compared with conventional aluminum alloys of similar electrical properties, renders it particularly suitable for use in overhead transmission cable and the like where the tensile strength is of primary significance and the electrical conductivity is of secondary concern.

In copending application Ser. No. 430,300, now U.S. Pat. No. 3,920,411 of which the instant application is a continuation-in-part, there is disclosed an aluminum alloy electrical conductor having a minimum conductivity of 58% IACS and consists essentially of from about 0.35 to about 4.0 weight percent cobalt, from about 0.1 to about 2.5 weight percent iron, the remainder being aluminum with associated trace elements, said aluminum alloy electrical conductor having the following properties when measured as a number 10 A.W.G. fully annealed wire:

Tensile Strength: 12,000–24,000 psi
Elongation: 12 percent – 30 percent
Yield Strength: 8,000 – 18,000 psi.

The conductor of the aforementioned application is formulated from an aluminum based alloy prepared by mixing cobalt, iron and optionally other alloying elements with aluminum in a furnace to obtain a melt having requisite percentages of elements. The aluminum content of the alloy could vary from about 93.50 percent to about 99.65 percent by weight. The optional alloying element or group of alloying elements could be present in a total concentration of up to 2.50 percent by weight, preferably from 0.1 percent to about 1.75 percent by weight.

After preparing the melt, the aluminum alloy was continuously cast into a continuous bar by a continuous casting machine and then, substantially immediately thereafter, hot-worked in a rolling mill to yield a continuous aluminum alloy rod.

As further described in the aforementioned copending application Ser. No. 430,300, now U.S. Pat. No. 3,920,411 a continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it is solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands function to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectional shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast-aluminum bar.

According to the method described in the aforementioned copending application, the continuous rod was cold-drawn through a series of progressively constricted dies, without intermediate anneals, to form a continuous wire of desired diameter. Thereafter, the wire was annealed or partially annealed to obtain a desired tensile strength and cooled. The annealing operation was disclosed as being continuous as in resistance annealing, induction annealing, convection annealing by continuous furnaces or radiation annealing by continuous furnaces, or, preferably, batch annealed in a batch furnace.

In order to produce a product having improved percent ultimate elongation, increased ductuity and fatigue resistance, and increased electrical conductivity in accordance with the objects of the aforementioned copending application, it was necessary to anneal at temperatures of about 450° F to about 1200° F when continuously annealing with annealing times of about 5 minutes to about 1/10,000 of a minute. On the other hand, when batch annealing, a temperature of approximately 400° F to about 750° F was employed with resident times of about 30 minutes to about 24 hours.

It was further disclosed in the aforementioned copending application that the aluminum base alloy after cold-working includes an intermetallic compound precipitate. The compound is identified as Cobalt aluminate ($Co_2Al_9$). This intermetallic compound is found to be very stable and especially so at high temperatures. The compound also has a low tendency to coalesce during annealing of products formed from the alloy and the compound is generally incoherent with the aluminum matrix. The mechanism of strengthening for this alloy is in part due to the dispersion of the intermetallic compound as a precipitate throughout the aluminum matrix. The precipitate tends to pin dislocation sites which are created during cold working of products formed from the alloy. Upon examination of the intermetallic compound precipitate in a cold drawn product, it is found that the precipitates are oriented in the direction of drawing. In addition, it is found, when examining a No. 10 gauge wire, that the precipitates are rod-like in configuration and a majority are ¼ to ½ microns long and about ⅛ micron in diameter. The precipitates may also be spherical or plate-like. The cell size in this tested sample of wire is approximately ½ to 1 micron in cross-section.

Other intermetallic compounds may also be formed depending upon the constituents of the melt and the relative concentrations of the alloying elements. Those intermetallic compounds include the following: $NiAl_3$, $Ni_2Al_3$, MgCoAl, $FeAl_3$, $Fe_2Al_5$, $Co_4Al_{13}$, $CeAl_4$, $CeAl_2$, $VAl_{11}$, $VAl_7$, $VAl_6$, $VAl_3$, $WAl_{12}$, $Zr_3Al$, $Zr_2Al$, $LaAl_4$, $LaAl_2$.

SUMMARY OF THE INVENTION

It has now been found, in accordance with the instant invention, that in addition to the aforementioned primary intermetallic compound precipitates, which come out of solution during casting of the molten metal, the cold-worked product may be further strengthened by the presence of so-called secondary precipitates that come out of solid solution during annealing at approximately 200° F. These secondary precipitates are sized less than 1,000A and have been observed to limit subgrain growth to less than 0.6 microns until they substantially go back into solution at approximately 450° F. These secondary precipitates thus increase the tensile strength and yield strength (albeit at the cost of low elongation) provided that the annealing temperature does not exceed approximately 450° F. The electrical conductivity will be between 59.5 and 60.5 IACS. While wire manufactured according to the foregoing parameters could not be used for building wire (too low elongation and insufficient conductivity—i.e., less than 61 percent IACS), it is particularly suitable for applications requiring high tensile strength, such as overhead transmission cable.

While the prior art* has recognized that in hard drawn aluminum wires containing small amounts of iron and traces of silicon, the iron precipitates from solid solution during annealing to maintain the tensile strength at low annealing temperatures, the tensile strength of such products did not increase when annealed at higher temperatures, but rather remained substantially constant until dropping off at the onset of recovery. On the other hand, it has been determined in accordance with this invention that if the wire product is formulated from an alloy having sufficient amounts of alloying elements, such as of iron and cobalt, to yield a sufficient amount of precipitate particles to act as pinning points during subgrain coalescence, then the wire could be annealed at higher temperatures within the early stages of the recovery range such that the hardening effects of the secondary precipitates would offset the softening effect of recovery to the extent that there would be a net increase in ultimate tensile strength and yield strength as compared with conventional alloys having lower levels of alloying additions, such as EC aluminum. It is believed that EC aluminum does not have sufficient amounts of iron in solid solution to cause any significant precipitation when annealed at 200°–300° F, and thus it does not exhibit any increase in tensile strength when processed according to the method of the instant invention.

*Roth, A., "On the Solubility of Iron in Aluminum," *Z. Metallkunde*, Vol. 31, 1939, pp. 299–301.

It is, therefore, a primary object of this invention to provide an aluminum alloy electrical conductor having improved properties of ultimate tensile strength and yield strength as compared with conventional electrical conductors.

More particularly, it is an object of this invention to provide a hard-drawn aluminum electrical conductor where the tensile strength thereof is increased by the presence of both primary and secondary intermetallic precipitates that act to pin dislocation sites between adjacent subgrain boundaries.

Another object of this invention is to provide a novel method of manufacturing an aluminum alloy electrical conductor having sufficient amounts of alloying additions so as to yield secondary precipitates during annealing at temperatures within the early stages of the recovery range such that the hardening effect of the secondary precipitates will offset the softening effect of recovery to the extent that there will be a net increase in ultimate tensile strength and yield strength as compared with conventional alloys.

More specifically, it is an object of this invention to provide a method of manufacturing an aluminum alloy electrical conductor which includes the steps of:

a. alloying a minimum of 93.5 weight percent molten aluminum containing normal trace impurities with at least one additional alloying element in sufficient proportion to yield intermetallic precipitates during subsequent solidification and thermomechanical processing;

b. casting the molten aluminum alloy into a cast bar at a rate sufficient to form primary intermetallic precipitates of said alloying element;

c. hot-working the cast bar substantially immediately after casting to form rod and to break-up said primary precipitates;

d. drawing said rod through a series of wire-drawing dies, without preliminary or intermediate anneals, to form wire and to further break-up and distribute said primary precipitates throughout the aluminum matrix;

d. annealing said wire at a temperature and for a period of time sufficient to produce secondary intermetallic precipitates of said alloying element; and f. terminating said annealing step prior to primary recrystallization whereby both said primary and secondary precipitates will act to pin dislocation sites between adjacent subgrain boundaries thereby increasing the ultimate tensile strength and yield strength of the conductor.

IN THE DRAWINGS

Figure 3:
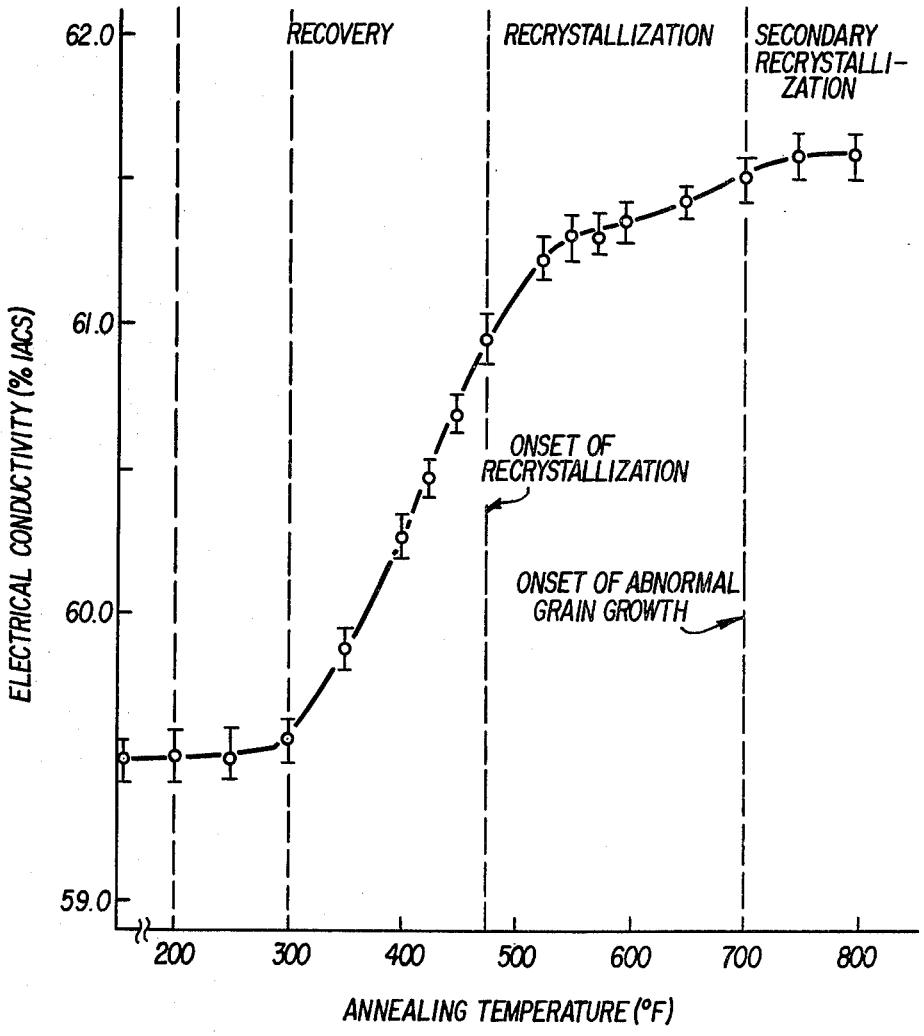
Figure 4:
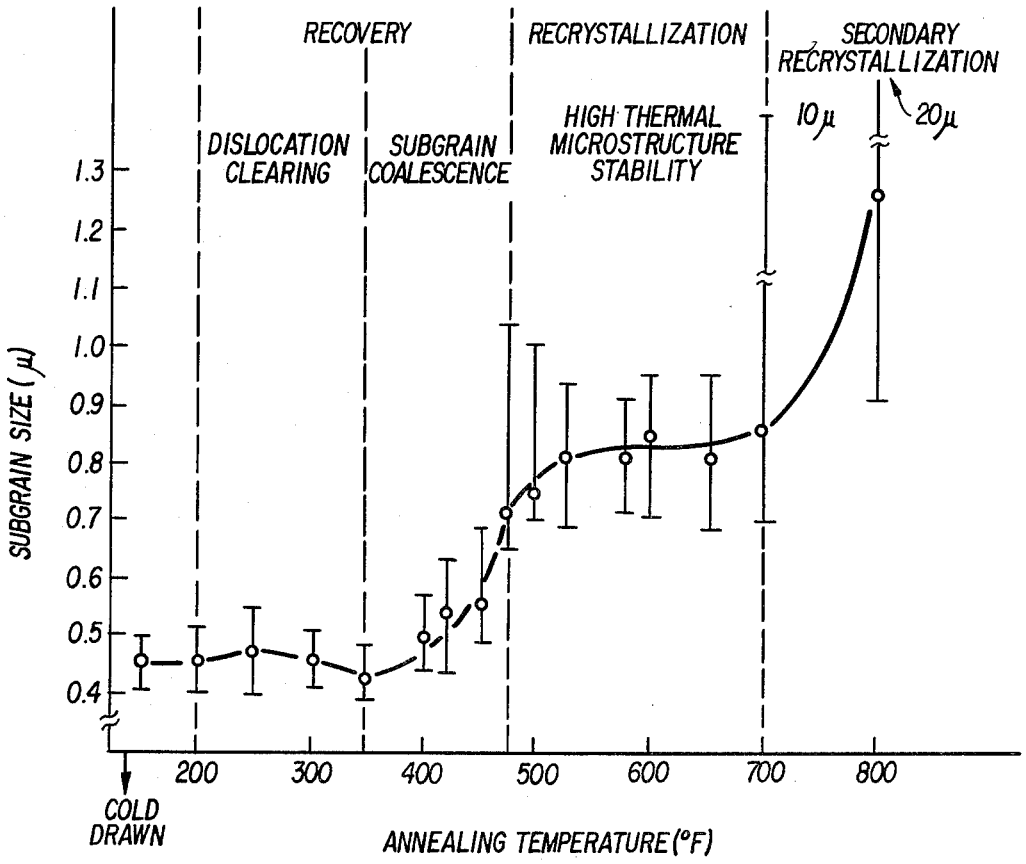

FIG. 3 is a plot of ELECTRICAL CONDUCTIVITY v. ANNEALING TEMPERATURE for a product manufactured in accordance with the instant invention, and illustrates a sharp increase in the electrical conductivity above 300° F; and FIG. 4 is a plot of SUBGRAIN SIZE v. ANNEALING TEMPERATURE for a product manufactured in accordance with the instant invention, and illustrates the effect of the secondary precipitates which maintain the subgrain size to less than 0.6 microns until they go back into solution at approximately 400° F.

DESCRIPTION OF PREFERRED FORMS OF THE INVENTION

The above-described as well as other objects of the invention that may become more apparent hereinafter are accomplished in accordance with a preferred form of the invention by first mixing cobalt and iron, and optionally other alloying elements, with aluminum in a furnace to obtain a melt having requisite percentages of elements. It has been found that suitable results are obtained with cobalt being present in a weight percentage of about 0.2 to about 4.0, and iron present in a weight percentage of from about 0.2 to about 2.5. Superior results are achieved when cobalt is present in a weight percentage of from about 0.35 to about 2.0, and iron is present in a weight percentage of from about 0.3 to about 1.5. Particularly superior and preferred results are obtained when cobalt is present in a weight percentage of from about 0.4 to about 0.95, and iron is present in a weight percentage of from about 0.4 to about 0.95.

The aluminum content of the present alloy may vary from about 93.50 percent to about 99.6 percent. If commercial aluminum is employed in preparing the present melt, it is preferred that the aluminum, prior to adding to the melt in the furnace, contain no more than 0.1 percent total of trace impurities.

Optionally the present alloy may contain an additional alloying element or group of alloying elements. The total concentration of the optional alloying elements may be up to 2.50 percent by weight; preferably from about 0.1 percent to about 1.75 percent by weight is employed. Particularly superior and preferred results are obtained when 0.1 percent to about 1.5 percent by weight of total additional alloying elements is employed.

Additional alloying elements include the following:

| ADDITIONAL ALLOYING ELEMENTS | | |
|---|---|---|
| Magnesium | Cesium | |
| Nickel | Yttrium | Rhenium |
| Copper | Scandium | Dysprosium |
| Silicon | Thorium | Terbium |
| Zirconium | Tin | Erbium |
| Cerium | Molybdenum | Neodymium |
| Niobium | Zinc | Indium |
| Hafnium | Tungsten | Boron |
| Lanthanum | Antimony | Thallium |
| Tantalum | Bismuth | Rubidium |

Particularly superior and preferred results are obtained with the following additional alloying elements in the percentages, by weight, as shown:

| PREFERRED ADDITIONAL ALLOYING ELEMENTS | |
|---|---|
| Magnesium | 0.01 to 1.0 % |
| Nickel | 0.05 to 2.50% |
| Copper | 0.05 to 2.50% |
| Silicon | 0.05 to 1.0 % |
| Zirconoium | 0.01 to 1.0 % |
| Niobium | 0.01 to 2.0 % |
| Tantalum | 0.01 to 2.0 % |
| Yttrium | 0.01 to 1.0 % |
| Scandium | 0.01 to 1.0 % |
| Thorium | 0.01 to 1.0 % |
| Rare Earth Metals | 0.01 to 2.50% |
| Boron | 0.01 to 1.0 % |
| Indium | 0.01 to 1.0 % |

The rare earth metals may be present either individually within the percentage range or as a partial or total group, the total percentage of the group being within the percentage range.

It should be understood that the additional alloying elements may be present either individually or as a group of two or more of the elements. It should be understood, however, that if two or more of the additional alloying elements are employed, the total concentration of additional alloying elements should not exceed 2.50 percent by weight.

Thereafter, the melt is continuously cast into a bar, rolled into rod, and drawn down into wire as described in the aforementioned copending application Ser. No. 430,300, now U.S. Pat. No. 3,920,411 the disclosure of which is incorporated by reference herein. During this thermomechanical processing, primary intermetallic compound precipitates will be formed. If the alloy contains iron and cobalt in amounts falling within the aforementioned ranges, the intermetallic precipitates will be of the form $FeAl_3$, $(CoFe)_2Al_9$ and $Co_2Al_9$.

However, in accordance with the instant invention, rather than being annealed according to the parameters disclosed in said copending application, the wire is annealed at a temperature and for a period of time such that secondary precipitates will come out of solution to assist the primary precipitates in pinning disclocation sites between subgrain boundaries. These precipitates, which were not found to be present in as-drawn wire specimens, are of the phases $FeAl_3$, $(CoFe)_2Al_9$ and $(CoFe)_2Al_9$. These secondary precipitates were found to be less than 1,000A in size. A more complete understanding of the invention will be obtained from the following example:

EXAMPLE

A melt was prepared by mixing 0.5 weight percent iron, 0.5 weight percent cobalt, and the remainder aluminum containing less than 0.1 percent trace impurities in a graphite crucible. The melt was held for a sufficient time and at a sufficient temperature to allow complete solubility of the alloying elements with the base aluminum. An argon atmosphere was provided over the melt to prevent oxidation. The melt was continuously cast on a continuous casting machine and immediately hot-rolled through a rolling mill to ⅜ inch diameter continuous rod. The wire was then drawn from the rod without any preliminary or intermediate anneals into 0.105 inch diameter wire. The wire was isochronally annealed for 1 hour at 300° F. The annealed wire was found to have a tensile strength of 35,000 psi, a yield strength of 31,000 psi, an elongation of approximately 2 percent, and an electrical conductivity of 59.5 percent IACS.

Figure 1:
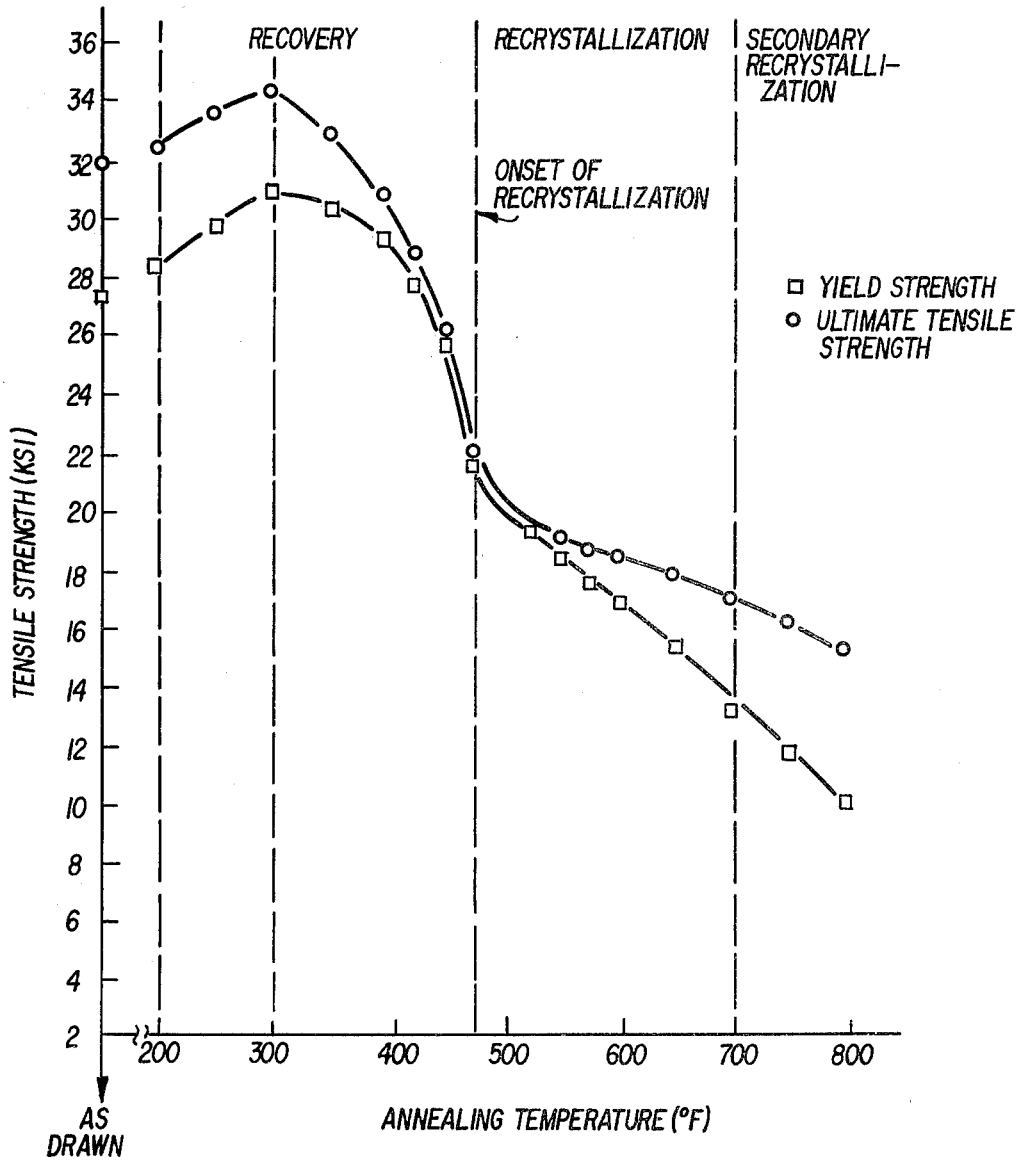
FIG. 1 is a plot of TENSILE STRENGTH v. ANNEALING TEMPERATURE for a product manufactured in accordance with the instant invention, and illustrates an increase in both the ultimate tensile strength and yield strength during the early stages of the recovery range.
Figure 2:
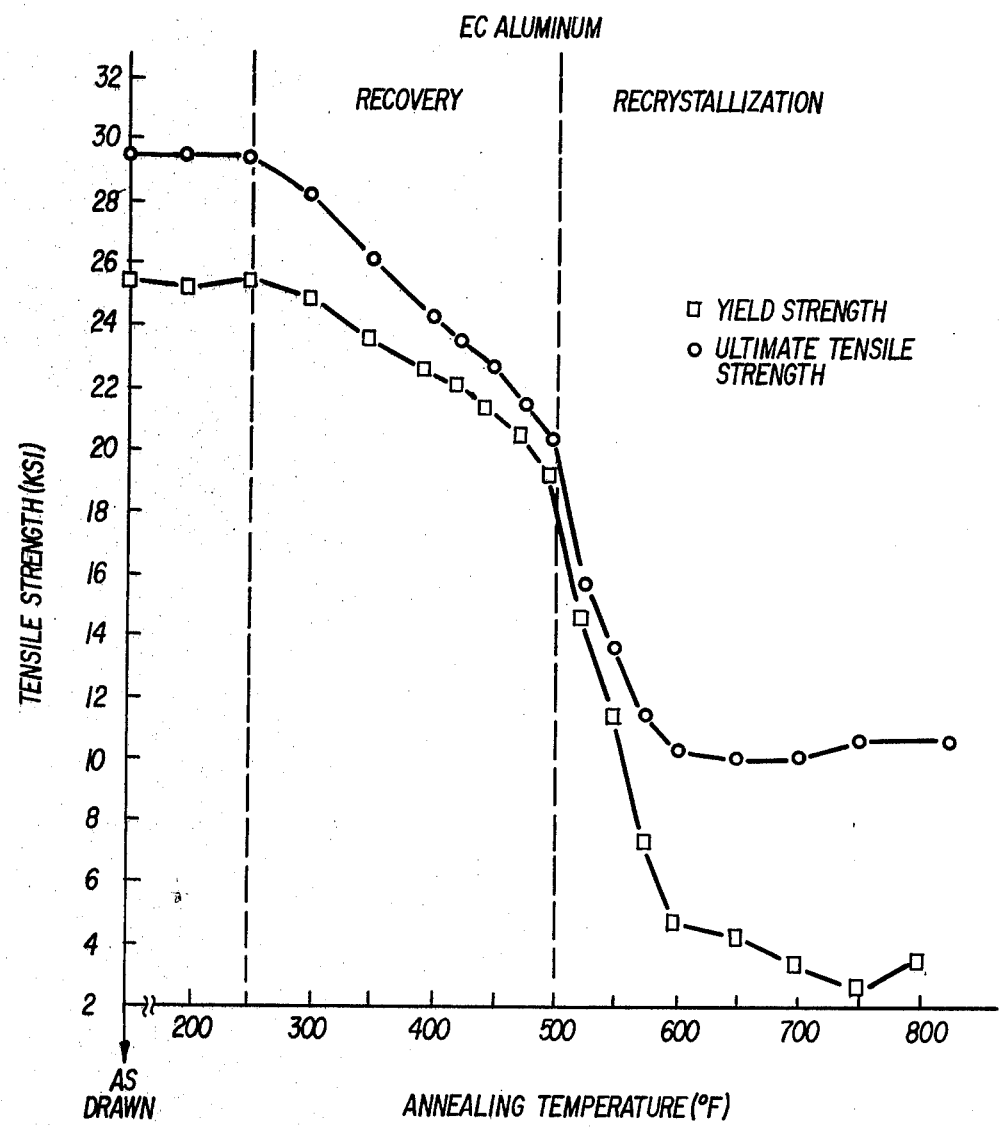
FIG. 2 is a plot of TENSILE STRENGTH v. ANNEALING TEMPERATURE for an EC ALUMINUM wire product, and illustrates no increase in either the ultimate tensile strength or yield strength during annealing.

Referring now to FIG. 1, which is a plot of TENSILE STRENGTH v. ANNEALING TEMPERATURE for the product manufactured in accordance with the EXAMPLE, it can be seen that both the tensile strength and yield strength increase during annealing through the range of 200° F–300° F. On the other hand, in comparing FIG. 2, which is a plot of TENSILE STRENGTH v. ANNEALING for EC ALUMINUM manufactured in the same manner as the product of the EXAMPLE, it can be seen that both the tensile strength and yield strength are substantially constant when the product is annealed up to a temperature of 250° F, at values substantially less than the values for the product of the EXAMPLE at the same annealing temperatures.

Moreover, while the ultimate tensile strength and yield strength of the product of the EXAMPLE reach their maximums at an annealing temperature of 300° F, it should be apparent from FIG. 1 that both of these properties will continue to exhibit improved values, as compared with a non-annealed (i.e., "as-drawn") product, even when annealed up to 300°–400° F. The significance of this fact will be apparent by referring to FIG. 3, which is a plot of ELECTRICAL CONDUCTIVITY v. ANNEALING TEMPERATURE, and which illustrates that the conductivity of the product of the EXAMPLE is significantly improved by annealing above 300° F.

In view of the foregoing, it should be apparent that by annealing a wire product manufactured in accordance with the invention, at a temperature in the range of 350° F–400° F for 1 hour, it is possible to improve not only the electrical conductivity, but the tensile strength and yield strength as well, over non-annealed (i.e., "as-drawn") wire. This was totally unexpected, and in fact contrary to the prior art experience with EC aluminum wire. Heretofore, especially with EC aluminum, the hard-drawn product was either used in the "as-drawn" condition (non-annealed) if maximum tensile strength was desired, or was annealed in excess of 400° F so as to obtain an improvement in its elongation characteristics. Thus, the method of the instant invention presents the heretofore unrecognized advantages of low temperature annealing of a hard-drawn wire product.

Referring now to FIG. 4, which is a plot of SUBGRAIN SIZE v. ANNEALING TEMPERATURE, it can be seen that the subgrains in the aluminum matrix of a wire product manufactured in accordance with this invention are maintained substantially constant in size, at less than 0.6 microns, up to annealing temperatures of 400° F–450° F. This is attributable to the pinning effect of the secondary precipitates that come out of solution at an annealing temperature of 200° F and which do not go back into solution until about 450° F. The secondary precipitates, in combination with the primary precipitates, which do not substantially completely go back into solution until the onset of secondary recrystallization at approximately 700° F, limit the size of the subgrain growth and thus contribute to the high tensile strength of the product in this range.

In view of the foregoing, it should be apparent that there is provided in accordance with this invention, a novel method of manufacturing an aluminum alloy electrical conductor that has improved properties of ultimate tensile strength and yield strength as compared with conventional electrical conductors.

Although only preferred embodiments of the invention have been specifically described herein, it is to be understood that minor modifications could be made therein without departing from the spirit and scope of the invention as defined in the appended claims.

We claim:

1. Method of manufacturing a high tensile strength aluminum alloy electrical conductor comprising the steps of:

a. alloying a minimum of 93.5 weight percent molten aluminum containing normal trace impurities with at least one additional alloying element in an amount effective to yield intermetallic precipitates during subsequent solidification and thermomechanical processing;

b. casting the molten aluminum alloy into a cast bar at a rate sufficient to form primary intermetallic precipitates of said alloying element from said alloyed molten aluminum;

c. hot-working the cast bar substantially immediately after casting to form rod and to break-up said primary precipitates;

d. drawing said rod through a series of wire-drawing dies, without preliminary or intermediate anneals, to form wire and to further break-up and distribute said primary precipitates throughout the aluminum matrix;

e. annealing said wire at a temperature of from 200°–400° F for a period of time sufficient to precipitate secondary intermetallic compounds of said alloying element from the solid solution; and f. terminating said annealing step prior to primary recrystallization to permit both said primary and secondary precipitates to pin dislocation sites between adjacent subgrain boundaries and to thus increase the ultimate tensile strength and yield strength of the conductor above the as-drawn condition.

2. The method of claim 1 wherein said annealing step is performed at a temperature within the range corresponding to the onset of recovery.

3. The method of claim 1 wherein said additional alloying elements are iron and cobalt, and said intermetallic precipitates are of the phases $FeAl_3$, $(CoFe)_2Al_9$ and $Co_2Al_9$.

4. The method of claim 3 wherein cobalt is present in a weight percent of from about 0.2 to about 4.0 and iron is present in a weight percent of from about 0.2 to about 2.5.

5. The method of claim 3 wherein cobalt is present in a weight percent of from about 0.35 to about 2.0 and iron is present in a weight percent of from about 0.3 to about 1.5.

6. The method of claim 3 wherein cobalt is present in a weight percent of from about 0.4 to about 0.95 and iron is present in a weight percent of from about 0.4 to about 0.95.

7. The method of claim 1 wherein said annealing step is performed in the range of 350°–400° F.

8. The method of claim 1 wherein said casting step is performed in in a moving mold formed between a groove in the periphery of a rotating casting wheel and a metal belt lying adjacent said groove for a portion of its length.

9. A high tensile strength aluminum alloy electrical conductor produced according to the method of claim 4 having a minimum conductivity of 58% IACS, said conductor being in the form of a hard-drawn wire annealed at a temperature within the range corresponding to the onset of of recovery such that the wire includes both primary intermetallic compounds, which precipitate from the molten alloyed aluminum upon solidification, and secondary intermetallic compounds, which precipitate from the solid solution of the solidified alloyed aluminum during annealing, of the phases $FeAl_3$, $Co_2Al_9$ and $(CoFe)_2Al_9$ as strengthening agents whereby the ultimate tensile strength of the wire is at least 30,000 psi and the yield strength is at least 28,000 psi.

10. The aluminum alloy electrical conductor of claim 9 wherein cobalt is present in a weight percent of from about 0.35 to about 2.0 and iron is present in a weight percent of from about 0.3 to about 1.5.

11. The aluminum alloy electrical conductor of claim 9 wherein cobalt is present in a weight percent of from about 0.4 to about 0.95 and iron is present in a weight percent of from about 0.4 to about 0.95.

12. The aluminum alloy electrical conductor of claim 9 wherein said secondary precipitates have a size less than 1000A, and the subgrains in the aluminum matrix have a size less than 0.6 microns.

13. The aluminum alloy electrical conductor of claim 9 further including an additional alloying element selected from the group consisting of magnesium, copper, silicon, zirconium, niobium, tantalum, yttrium, scandium, thorium, Boron, rare earth metals, and mixtures thereof, the combined weight percentage of said additional alloying elements not to exceed about 1.75 weight percent.

14. Method of manufacturing a high tensile strength aluminum alloy electrical conductor comprising the steps of:

a. alloying from about 0.2 to about 4.0 weight percent cobalt, from about 0.2 to about 2.5 weight percent iron, and a minimum of 93.5 weight percent molten aluminum containing normal trace impurities with at least one additional alloying element in amounts effective to yield intermetallic precipitates during subsequent solidification and thermomechanical processing, said additional alloying element selected from the group consisting of:

| | | |
|---|---|---|
| Magnesium | Cesium | Rhenium |
| Nickel | Yttrium | Dysprosium |
| Copper | Scandium | Terbium |
| Silicon | Thorium | Erbium |
| Zirconium | Tin | Neodymium |
| Cerium | Molybdenum | Indium |
| Niobium | Zinc | Boron |
| Hafnium | Tungsten | Thallium |
| Lanthanum | Antimony | Rubidium |
| Tantalum | Bismuth | Mixtures of two or more of the above |

b. casting the molten aluminum alloy into a cast bar at a rate sufficient to form primary intermetallic precipitates of said alloying elements from said alloyed molten aluminum;

c. hot-working the cast bar substantially immediately after casting to form rod and to break-up said primary precipitates;

d. drawing said rod through a series of wire-drawing dies, without preliminary or intermediate anneals, to form wire and to further break-up and distribute said primary precipitates throughout the aluminum matrix;

e. annealing said wire at a temperature of from 200°–400° F for a period of time sufficient to precipitate secondary intermetallic compounds of said alloying element from the solid solution; and f. terminating said annealing step prior to primary recrystallization to permit both said primary and secondary precipitates to pin dislocation sites between adjacent subgrain boundaries and to thus increase the ultimate tensile strength and yield strength of the conductor above the as-drawn condition.

* * * * *